United States Patent [19]

Kuzel et al.

[11] 4,247,424

[45] Jan. 27, 1981

[54] STABLE LIQUID DETERGENT COMPOSITIONS

[75] Inventors: Maryann Kuzel; John W. Leikhim; James M. Gajewski; Malcolm L. Allen, all of Cincinnati, Ohio

[73] Assignee: The Procter & Gamble Company, Cincinnati, Ohio

[21] Appl. No.: 83,908

[22] Filed: Oct. 11, 1979

[51] Int. Cl.[3] ..... C11D 1/72; C11D 1/75; C11D 10/02; C11D 17/08

[52] U.S. Cl. ..... 252/528; 252/153; 252/173; 252/174.16; 252/174.19; 252/174.21; 252/309; 252/351; 252/352; 252/354; 252/357; 252/526; 252/538; 252/545; 252/546; 252/547; 252/557; 252/DIG. 1; 252/DIG. 14; 252/DIG. 17

[58] Field of Search ..... 252/153, 173, 174.16, 252/174.21, 174.22, 351, 352, 354, 357, 309, 526, 527, 528, 538, 545, 546, 547, 557, DIG. 1, DIG. 14, DIG. 17

[56] References Cited

U.S. PATENT DOCUMENTS

| | | | |
|---|---|---|---|
| 3,317,430 | 5/1967 | Priestley | 252/547 |
| 3,341,459 | 9/1967 | Davis | 252/528 |
| 3,351,557 | 11/1967 | Almstead | 252/106 |
| 3,441,612 | 4/1969 | Drew | 260/584 |
| 3,537,993 | 11/1970 | Coward | 252/8.75 |
| 3,843,563 | 10/1974 | Davies | 252/547 |
| 3,914,185 | 10/1975 | Inamorato | 252/546 |
| 3,953,382 | 4/1976 | Nelson | 252/548 |
| 3,963,649 | 6/1976 | Spadini | 252/546 |
| 3,983,078 | 9/1976 | Collins | 252/540 |
| 3,983,079 | 9/1976 | Spadini | 252/545 |

OTHER PUBLICATIONS

Kass, G. S.; "New Techniques for Formulating Cosmetics with Lecithin", Cosmetics & Toiletries, vol. 94, pp. 25, 26, 28 & 30, Aug. 1979.

Krupin, F.; "Phosphate Ester Surfactants—Newer Uses", Soap & Chemical Specialties, May 1969, pp. 86–88, 90, 92 & 93.

*Primary Examiner*—Dennis L. Albrecht

*Attorney, Agent, or Firm*—Edmund F. Gebhardt; Thomas H. O'Flaherty; Richard C. Witte

[57] ABSTRACT

Liquid detergent compositions are disclosed which contain an ethoxylated alcohol or ethoxylated alkyl phenol nonionic surfactant, an amine oxide surfactant, a water-soluble detergency builder, a hydrophobic emulsifier and water, said liquid detergent compositions being stable emulsion.

8 Claims, No Drawings

STABLE LIQUID DETERGENT COMPOSITIONS

BACKGROUND OF THE INVENTION

1. Field of the Invention

This invention relates to stable liquid detergent compositions having superior detergent properties.

There has been considerable demand for liquid detergent compositions which provide superior detergency under a wide variety of conditions including cool water conditions. In order to obtain superior detergency under a wide variety of conditions, a number of components are needed. The formulation of stable liquid detergent compositions is difficult when the components tend to separate into discrete phases.

2. State of the Art

Liquid detergent compositions suitable for use in a home laundry operation first made their appearance during the period 1957–1960. In general, this involved an adaptation of granular detergent formulations into liquid form and utilized an alkylbenzene sulfonate surfactant and polyphosphate detergency builder system.

U.S. Pat. No. 3,351,557 issued Nov. 7, 1967, to Almstead et al is directed to the special problems of formulating a stable liquid detergent and discloses surfactant systems comprising an ethoxylated alkyl phenol and a sultaine or amine oxide surfactant.

U.S. Pat. No. 3,843,563 issued Oct. 22, 1974, to Davies et al discloses granular detergent compositions comprising a mixed ethoxylated alcohol-amine oxide surfactant system and an alkali metal carbonate.

The effectiveness of certain surfactant combinations involving ethoxylated nonionics and semi-polar or zwitterionic surfactants such as amine oxides or sultaines, has been recognized. However, it has not been known to form stable emulsions of the surfactant combinations of the present invention by using hydrophobic emulsifiers.

It is an object of this invention to provide a stable liquid detergent composition which has superior detergency characteristics, including cool water detergency characteristics.

It is a further object of this invention to provide a compatible, multi-component, liquid detergent composition in the form of a stable emulsion.

It is yet another object of this invention to provide mixtures of detergent compounds in a convenient concentrated liquid form.

These and other objects can be achieved by the compositions of the invention as hereinafter described.

SUMMARY OF THE INVENTION

The present invention encompasses a stable liquid detergent composition comprising:

(a) from about 5% to about 25% of an ethoxylated alcohol or ethoxylated alkyl phenol nonionic surfactant of the formula:

$R(C_2H_4O)_nOH$ wherein R is selected from the group consisting of aliphatic hydrocarbyl radicals containing from about 8 to about 18 carbon atoms, alkyl phenyl radicals wherein the alkyl group contains from about 8 to about 15 carbon atoms and mixtures thereof wherein n is from about 3 to about 12;

(b) from about 2% to about 15% of an amine oxide surfactant having the formula

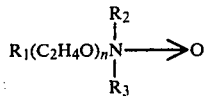

wherein $R_1$ is an alkyl, 2-hydroxyalkyl, 3-hydroxyalkyl, or 3-alkoxy-2-hydroxypropyl radical in which the alkyl and alkoxy contain from about 8 to about 18 carbon atoms, $R_2$ and $R_3$ are methyl, ethyl, propyl, isopropyl, 2-hydroxy ethyl, 2-hydroxypropyl, or 3-hydroxypropyl and n is from 0 to about 10;

(c) from about 5% to about 25% of a water-soluble detergency builder capable of sequestering calcium and magnesium ions in water solution selected from the group consisting of water-soluble polycarboxylates, polyacetates, phosphonates, pyrophosphates and mixtures thereof;

(d) from about 5% to about 25% of a hydrophobic emulsifier; and (e) from about 20% to about 83% water, said liquid detergent being a stable emulsion and having a pH of from about 8 to about 13.

DETAILED DESCRIPTION OF THE INVENTION

The stable liquid detergent compositions herein comprise five essential ingredients:

(a) ethoxylated nonionic surfactant;
(b) amine oxide surfactant;
(c) water-soluble sequestering detergency builder;
(d) hydrophobic emulsifier and
(e) water.

Ethoxylated Nonionic Surfactant

Suitable ethoxylated nonionic surfactants are:

1. The polyethylene oxide condensates of alkyl phenols. These compounds include the condensation products of alkyl phenols having an alkyl group containing from about 8 to about 15 carbon atoms, in either a straight chain or branched chain configuration, with ethylene oxide, the ethylene oxide being present in amounts equal to from about 3 to about 12 moles of ethylene oxide per mole of alkyl phenol. The alkyl substituent in such compounds may be derived, for example, from polymerized propylene or isobutylene, or from octene or nonene. Examples of compounds of this type include nonyl phenol condensed with about 9.5 moles of ethylene oxide per mole of nonyl phenol and dodecyl phenol condensed with about 8 moles of ethylene oxide per mole of dodecyl phenol. Commercially available nonionic surfactants of this type include Igepal CO-610, CA-420, CA-520 and CA-620, marketed by the GAF Corporation, and Triton X-45, X-114, X-100 and X-102, marketed by the Rohm and Haas Company.

2. The condensation products of aliphatic alcohols with ethylene oxide. The alkyl chain of the aliphatic alcohol may either be straight or branched and contains from about 8 to about 18 carbon atoms. Examples of such ethoxylated alcohols include the condensation product of about 5 moles of ethylene oxide with 1 mole of tridecanol, myristyl alcohol condensed with about 8 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with coconut alcohol. Examples of commercially available nonionic surfactants of this type include Tergitol 15-S-7 marketed by the Union Carbide Corporation and Neodol 23-6.5 marketed by the Shell Chemical Company. Whether the alcohol is derived from natural fats or produced by one of several petrochemical processes, a mixture of carbon chain lengths is typical. The stated degree of ethoxylation is an average, the spread being dependent on process conditions.

Ethoxylated alcohols are preferred because of their superior biodegradability relative to ethoxylated alkyl phenols. Particularly preferred are ethoxylated alcohols having an average of from about 9 to about 15 carbon atoms in the alcohol and an average degree of ethoxylation of from about 3 to about 7 moles of ethylene oxide per mole of alcohol.

The preferred ethoxylated nonionic surfactants will have HLB (hydrophile-lipophile balance) values of from about 10 to about 13 and limited water solubility. The HLB value of surfactants and emulsifiers can be determined experimentally in a well known fashion. The HLB value of compounds or mixtures of compounds in which the hydrophilic portion of the molecule is principally ethylene oxide can be estimated by the weight ratio of ethylene oxide portion to the liphophilic portion (e.g., the hydrocarbyl radical).

A preferred level in the compositions of the invention is from about 8% to about 18%.

Optional ethoxylated nonionic surfactants include:

(1) the condensation products of ethylene oxide with a hydrophobic base formed by the condensation of propylene oxide and propylene glycol, and (2) the condensation products of ethylene oxide with the product resulting from the reaction of propylene oxide and ethylenediamine. These surfactants are marketed by BASF-Wyandotte under the tradenames Pluronic and Tetronic respectively.

Amine Oxide Surfactant

The amine oxide surfactants of the present invention comprise compounds and mixtures of compounds having the formula:

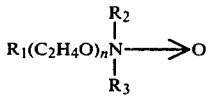

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are methyl, ethyl, propyl, isopropyl, 2-hydroxyethyl, 2-hydroxypropyl, or 3-hydroxypropyl and n is from 0 to about 10.

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds. A particularly preferred material is dimethyldodecylamine oxide. A preferred level of amine oxide surfactant in the compositions of the invention is from about 4% to about 8%.

Analogous to amine oxides is the class of surfactants designated phosphine oxides in which a phosphorus atom replaces the nitrogen atom in the molecular structure. Use of this class of surfactant has been discouraged by legislation restricting the phosphorus content of detergent compositions.

Water-Soluble Detergency Builder

Detergency builders are generally characterized by an ability to sequester or precipitate water hardness ions, calcium and magnesium in particular. Detergency builders may also be used to maintain or assist in maintaining an alkaline pH in a washing solution.

The essential detergency builders of the present invention have the ability to sequester calcium or magnesium ions in water solution. Sequestration is the formation of coordination complexes with metallic ions to prevent or inhibit precipitation or other interfering reactions. This phenomenon is also called chelation if certain structural criteria are met by the coordination complex.

The builders of the present invention fall into several classes of organic compounds and one inorganic class. The organic builders are those compounds which are designated polycarboxylates, polyacetates, aminopolycarboxylates, and phosphonates. The inorganic class comprises polyphosphates. The water-soluble pyrophosphates have the practical stability characteristics for use in the aqueous liquid products of the present invention and are preferred.

Examples of suitable polycarboxylate and polyacetate builder materials for use herein are sodium and potassium ethylenediaminetetraacetates, the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103; and water-soluble salts of polycarboxylate polymers and copolymers as described in U.S. Pat. No. 3,308,067, Diehl, issued Mar. 7, 1967, incorporated herein by reference.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other builders which can be used satisfactorily include water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

It is to be understood that while the alkali metal, and particularly the potassium salts of the foregoing inorganic and organic detergency builder salts are preferred for use herein from economic and solubility standpoints, the ammonium, alkanolammonium, e.g., triethanolammonium, diethanolammonium, and the like, water-soluble salt of any of the foregoing builder anions are also useful herein.

Other suitable polycarboxylates for use herein are the polyacetal carboxylates fully described in U.S. Pat. No. 4,144,226, issued Mar. 13, 1979 to Crutchfield et al, and U.S. Pat. No. 4,146,495, issued Mar. 27, 1979 to Crutchfield et al, the disclosures of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Preferred polycarboxylate and polyacetate builders for use in the present invention are sodium and potassium nitrilotriacetate, sodium and potassium citrate, and mixtures thereof.

Phosphonates suitable as detergency builders in the compositions of the invention include:

(a) ethane-1-hydroxy-1,1-diphosphonates of the formula

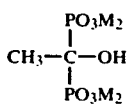

wherein each M is hydrogen or salt-forming radical;

(b) ethanehydroxy-1,1,2-triphosphonates of the formula

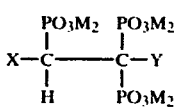

wherein X and Y are selected from the group consisting of hydrogen and hydroxyl such that when X is hydrogen, Y is hydroxyl and when X is hydroxyl, Y is hydrogen and in which each M is hydrogen or a salt-forming radical; and (c) oligomeric ester chain condensates of ethane-1-hydroxy-1,1-diphosphonates having the formula

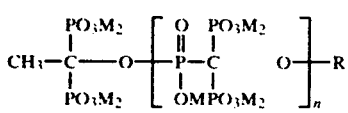

wherein each M is a soluble salt-forming radical, R is hydrogen or acetyl, and n has a number value in the range of about 1 to about 16.

Although the salts of tripolyphosphate, e.g., $K_5P_3O_{10}$ and the soluble polymeric metaphosphates, e.g., $(NaPO_3)_{6-12}$ are water-soluble detergency builders with the ability to sequester calcium and magnesium ions, they hydrolyze to a mixture of orthophosphate and pyrophosphate with prolonged storage in aqueous solutions. Orthophosphates precipitate but do not sequester calcium and magnesium ions. The water-soluble salts of pyrophosphoric acid are the polyphosphates proven most suitable for use in the practice of the present invention. Particularly preferred is potassium pyrophosphate. Compositions of the invention containing pyrophosphate preferably contain only a relatively low level of sodium ions. Sodium pyrophosphate has a tendency to precipitate from concentrated solutions at low storage temperatures.

Water

The compositions of this invention contain from about 20% to about 83% water, preferably from about 40% to about 65% water.

Hydrophobic Emulsifier

A critical element in the formulation of the stable liquid detergent compositions in emulsion form of the present invention is the selection and use of a hydrophobic emulsifier.

The hydrophobic emulsifiers of the invention are substantially water-insoluble and generally have an HLB value below about 8.5, preferably below about 7. Particularly useful are the alkali metal, ammonium and mono-, di-, and tri-$C_{1-4}$ alkyl and alkanol ammonium salts of dialkyl sulfosuccinic acid, said alkyl groups each containing from about 5 to about 20 carbon atoms, preferably from about 8 to about 18 carbon atoms.

Other hydrophobic emulsifiers are quarternary ammonium compounds with more than one alkyl group each containing at least 8 carbon atoms, e.g., di-$C_{12-18}$ alkyl ammonium chloride, bromide, methyl sulfate, nitrate and acetate and di-$C_{12-18}$ alkyl imidazolinium quaternary ammonium compounds.

Additional hydrophobic emulsifiers are the alkyl or alkyl ethoxy diesters of phosphoric acid having the formula:

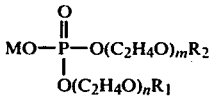

in which both $R_1$ and $R_2$ are alkyl groups containing from about 8 to about 20, preferably from about 10 to about 18, carbon atoms, n and m are from about zero to about 8 and M is hydrogen or a salt forming cation. Commercially available phosphate esters are mixtures of mono- and di-alkyl esters. Materials with a high percentage of di-esters are preferred. Lecithin, a natural phosphatidyl choline is a suitable hydrophobic emulsifier for the practice of the present invention.

Mixtures of the above hydrophobic emulsifiers or other emulsifiers within the scope of the invention may be utilized.

The level of hydrophobic emulsifiers required to maintain emulsion stability will depend on the nature and level of other ingredients, particularly the ethoxylated nonionic surfactant. A preferred level is from about 5% to about 16% by weight of the total composition.

Optional Components

In embodiments of the present invention the detergent compositions additionally can contain up to about 10%, preferably from about 1 to about 5%, of a fatty amide surfactant, such as ammonia amides, monoethanol amides, diethanol amides, and ethoxylated amides. Preferred amides are $C_8$–$C_{20}$ monoethanol amides, $C_8$–$C_{20}$ diethanol amides, and amides having the formula $$R-\overset{\overset{\displaystyle O}{\|}}{C}-\overset{\overset{\displaystyle H}{|}}{N}-CH_2CH_2OCH_2CH_2OH,$$

wherein R is a $C_8$–$C_{20}$ alkyl group, and mixtures thereof. Particularly preferred amides are those where the alkyl group contains from about 10 to about 16 carbon atoms, such as coconut alkyl monoethanol or diethanol amide. Such compounds are commercially available under the tradenames Superamide GR, from Onyx Chemical Co., Jersey City, N.J., Superamide F-3 from Ryco, Inc., Conshohocken, Pa., and Gafamide CDD-518, available from GAF Corp., New York, N.Y.

These amide components can be added to act as suds modifiers. Specifically, they tend to boost the sudsing in an active system which exhibits relatively low sudsing, and can depress the sudsing in systems which exhibit high sudsing.

The compositions of the present invention may also contain additional ingredients generally found in laundry detergent compositions, at their conventional art-established levels, as long as these ingredients are compatible with the components required herein. For example, the compositions can contain up to about 15%, preferably up to about 5%, and most preferably from about 0.001 to about 2%, of a suds suppressor component. Typical suds suppressors useful in the compositions of the present invention include, but are not limited to, those described below.

Preferred silicone-type suds suppressing additives are described in U.S. Pat. No. 3,933,672, issued Jan. 20, 1976, Bartolotta et al, incorporated herein by reference. The silicone material can be represented by alkylated polysiloxane materials such as silica aerogels and xerogels and hydrophobic silicas of various types. The silicone material can be described as a siloxane having the formula:

$$\left(\begin{array}{c} R \\ | \\ -Si-O- \\ | \\ R' \end{array}\right)_x$$

wherein x is from about 20 to about 2,000, and R and R′ are each alkyl or aryl groups, especially methyl, ethyl, propyl, butyl and phenyl. Polydimethylsiloxanes (R and R′ are methyl, having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of such ingredients include diethyl-, dipropyl-, dibutyl-, methylethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/gm$ intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active, detergent-impermeable carrier.

Particularly useful suds suppressors are the self-emulsifying silicone suds suppressors, described in U.S. Pat. No. 4,075,118, Gault et al, issued Feb. 21, 1978, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and mono-oleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g., monostearyl phosphate, up to about 50 mole percent of dialkyl phosphate and up to about 5 mole percent of trialkyl phosphate.

Other adjunct components which can be included in the compositions of the present invention include anionic, zwitterionic and ampholytic surfactants; bleaching agents; bleach activators; soil release agents (particularly copolymers of ethylene terephthalate and polyethylene oxide terephthalate, such as Milease T sold by ICI, United States, as disclosed in U.S. Pat. No. 4,132,680, Nicol, issued Jan. 2, 1979, incorporated herein by reference); soil suspending agents; corrosion inhibitors; dyes; fillers; optical brighteners; germicides; pH adjusting agents; alkalinity sources; enzymes; enzyme-stabilizing agents; perfumes; solvents; carriers; opacifiers; and the like. The required pH of from about 8 to about 13 can be obtained by the use of suitable alkaline materials such as sodium hydroxide, sodium or potassium carbonate or bicarbonate, sodium or potassium silicates and the alkaholamines. Particularly preferred is monoethanol amine.

Suitable optical brightening agents include:

(1) The reaction product of about one mole of ethylene oxide and one mole of 1,2-bis(benzimidazolyl) ethylene, e.g., N-(2'-hydroxyethyl)-1,2-bis(benzimidazolyl) ethylene;

(2) Tetrasodium 4,4'-bis[(4''-bis(2'''-hydroxyethyl)-amino-6''-(3'''-sulfophenyl)amino-1'',3'',5''-triazin-2''-yl)amino]-2,2'-stilbenedisulfonate;

(3) N-(2-hydroxyethyl-4,4'-bis(benzimidazolyl)stilbene;

(4) Disodium-4-(6'-sulfonaphthc[1',2'-d]triazol-2-yl)-2-stilbenesulfonate;

(5) Disodium-4,4'-bis[6 methyl ethanolamine)-3-anilino-1,3,5-triazin-2''-yl]-2,2'-stilbenedisulfonate;

(6) Disodium 4,4'-bis[(4''-(2'''-hydroxyethoxy)-6''-anilino-1'',3'',5''-triazin-2''-yl)amino]-2,2'-stilbenedisulfonate;

(7) 1,2-bis(5'-methyl-2'-benzoxazolyl)ethylene;

(8) 4-methyl-7-dimethylaminocoumarin;

(9) 2-styrylnaphth[1,2-d]oxazole;

(10) The reaction product of one mole of 4,4'-bis(benzimidazolyl)stilbene with about 0.5 mole of ethylene oxide and 0.5 mole of propylene oxide; and

(11) Mixtures thereof.

These optical whitening agents are used in a level of from about 0.03% to about 0.8% and preferably at a level of about 0.4% by weight.

Because of the performance advantages of the present invention, surfactants additional to the essential components will not generally be necessary.

Examples of additional surfactants which may be used in the compositions of the present invention are found in U.S. Pat. No. 3,717,630, Booth, issued Feb. 20, 1973, incorporated herein by reference. However, these components should be used in an amount as to be certain that they will be compatible with the essential surfactant system.

All percentages, parts, and ratios used herein are by weight unless otherwise specified.

The following nonlimiting examples illustrate the compositions of the present invention.

EXAMPLE I

Stable emulsion liquid detergent compositions are prepared by mixing the following ingredients:

| | A | B | C | D |
|---|---|---|---|---|
| $C_{12-13}$ alcohol - 6.5 ethylene oxide | 11.5% | 11.5% | — | — |
| $C_{11-15}$ alcohol - 5 ethylene oxide | — | -- | 10% | 10% |
| Dimethyl $C_{12-16}$ alkyl amine oxide | 6.7 | 6.7 | 5 | 5 |
| Sodium citrate | 10.0 | | | |
| Sodium nitrilotriacetate | — | 12.5 | 5.0 | 5.0 |
| Potassium pyrophosphate | — | — | 10.0 | 10.0 |
| Sodium dioctyl sulfosuccinate | 5.0 | 5.0 | 6.0 | -- |
| Lecithin | — | - | -- | 5.0 |
| Monoethanolamine | 3.0 | 3.0 | 3.0 | 3.0 |
| Ethanol | 0.5 | 0.5 | 0.5 | 0.5 |
| Water | 60.8 | 58.3 | 58.0 | 65.5 |
| Miscellaneous | 1.0 | 1.0 | 1.0 | 1.0 |

The compositions above are prepared by mixing the ethoxylated nonionic surfactant with the hydrophobic emulsifier (sodium dioctyl sulfosuccinate) and adding the remaining components under high shear mixing. Stable water-in-oil emulsions are formed. Miscellaneous includes perfume, fabric brighteners and coloring agents.

Excellent fabric cleaning relative to available commercial liquid detergent products is obtained at a usage of ½ cup of product in 12–25 gallons capacity washing machines.

Sodium mellitate and potassium ethane-1-hydroxy, 1,1-diphosphonate are substituted for the sodium citrate in A and the sodium nitrilotriacetate in B, C and D. Equivalent results are obtained.

We claim:

1. A stable liquid detergent composition comprising:

(a) from about 5% to about 25% of an ethoxylated alcohol or ethoxylated alkyl phenol nonionic surfactant of the formula:

$$R(C_2H_4O)_nOH$$

wherein R is selected from the group consisting of aliphatic hydrocarbyl radicals containing from about 8 to about 18 carbon atoms, alkyl phenyl radicals wherein the alkyl group contains from about 8 to about 15 carbon atoms and mixtures thereof wherein n is from about 3 to about 12;

(b) from about 2% to about 15% of an amine oxide surfactant having the formula

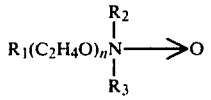

wherein $R^1$ is an alkyl, 2-hydroxyalkyl, 3-hydroxyalkyl, or 3-alkoxy-2-hydroxypropyl radical in which the alkyl and alkoxy contain from about 8 to about 18 carbon atoms, $R_2$ and $R_3$ are methyl, ethyl, propyl, isopropyl, 2-hydroxy ethyl, 2-hydroxypropyl, or 3-hydroxypropyl and n is from 0 to about 10;

(c) from about 5% to about 25% of a water-soluble detergency builder capable of sequestering calcium and magnesium ions in water solution selected from the group consisting of water-soluble polycarboxylates, polyacetates, phosphonates, pyrophosphates and mixtures thereof;

(d) from about 5% to about 25% of a hydrophobic emulsifier having an HLB value below about 7; and (e) from about 20% to about 83% water, said liquid detergent composition being a stable water-in-oil emulsion and having a pH of from about 8 to about 13.

2. The composition of claim 1 wherein the ethoxylated nonionic surfactant of the formula $R(C_2H_4O)_nOH$ is an ethoxylated alcohol, R contains from about 9 to about 15 carbon atoms and n is from about 3 to about 7.

3. The composition of claim 2 wherein the amine oxide surfactant is selected from the group consisting of dimethyldodecylamine oxide, dimethyltridecylamine oxide, dimethyltetradecyclamine oxide, dimethylpentadecyl amine oxide, dimethylhexadecyl amine oxide and mixtures thereof.

4. The composition of claim 3 wherein the water-soluble detergency builder comprises an organic polycarboxylate.

5. The composition of claims 1, 2 or 3 wherein the water-soluble detergency builder is selected from the group consisting of the alkali metal salts of citric acid, nitrilotriacetic acid, pyrophosphoric acid and mixtures thereof.

6. The composition of claim 4 wherein the hydrophobic emulsifier comprises a compound selected from the group consisting of dialkyl sulfosuccinates, wherein said alkyl groups each contain from about 5 to about 20 carbon atoms, alkyl diesters of phosphoric acid having the formula

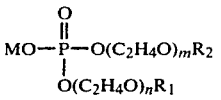

in which both $R_1$ and $R_2$ are alkyl groups containing from about 8 to about 20 carbon atoms, n and m are from zero to about 8, and M is hydrogen or a salt-forming cation, lecithin and mixtures thereof.

7. The composition of claims 1, 3, 4 or 6 wherein the ethoxylated nonionic surfactant is from about 8% to about 18% by weight, the amine oxide surfactant is from about 4% to about 8% by weight, the hydrophobic emulsifier is from about 8% to about 16% by weight and water is from about 40% to about 65% by weight.

8. The composition of claims 1, 3, 4 or 6 wherein the ethoxylated alcohol or ethoxylated alkyl phenol nonionic surfactant has an HLB value in the range of from about 10 to about 13.

* * * * *